United States Patent [19]

Ohashi et al.

[11] Patent Number: 4,794,420

[45] Date of Patent: Dec. 27, 1988

[54] DEVICE FOR DRIVING ROTARY BODY

[75] Inventors: Michihito Ohashi, Yokohama; Shinji Nagatsuna, Tokyo; Kinzi Saito, Kawasaki, all of Japan

[73] Assignee: Ricoh Company, Ltd., Tokyo, Japan

[21] Appl. No.: 126,115

[22] Filed: Nov. 27, 1987

[30] Foreign Application Priority Data

Nov. 27, 1986 [JP] Japan ..... 61-182285[U]

[51] Int. Cl.[4] ..... G03G 15/00

[52] U.S. Cl. ..... 355/3 R; 355/3 DD; 355/3 SH

[58] Field of Search ..... 355/3 DD, 14 D, 3 SH, 355/14 SH, 10, 3 R; 271/3.1, 4, 109, 111; 118/656–658, 661

[56] References Cited

U.S. PATENT DOCUMENTS 4,600,929 7/1986 Cordona et al. ..... 271/4 X 4,743,938 5/1988 Ohno ..... 355/3 DD

*Primary Examiner*—R. L. Moses

*Attorney, Agent, or Firm*—Oblon, Fisher, Spivak, McClelland & Maier

[57] ABSTRACT

A device for driving a rotary body which is required to make contact with another rotary body with an even pressure distribution along its length, e.g. a register roller installed in an electrophotographic machine for feeding a paper sheet, a developing roller applicable to a contact type developing system, or a doctor roller of a developing apparatus. A developing roller, or one of the rotary bodies, is movable in a single limited direction toward and away from a photoconductive element, or the other rotary body, which is fixed in place. A drive gear is meshed with a driven gear which is mounted on one end of a shaft of the developing roller, thereby transmitting torque to the developing roller. The drive gear is located in such a position that an angle between the direction of movement of the developing roller and a line extending through the axes of the drive and driven gears is defined upstream of that direction of movement with respect to the direction of rotation of the developing roller and substantially equal to the pressure angle between the drive and driven gears. The force imparted from the drive gear to the driven gear acts in a direction substantially perpendicular to the direction of movement of the developing roller.

6 Claims, 10 Drawing Sheets

DEVICE FOR DRIVING ROTARY BODY

BACKGROUND OF THE INVENTION

The present invention relates to a device for driving an elongate cylindrical rotary body which is required to make contact with another similar rotary body with an even pressure distribution along its length, e. g. a register roller of a machine for electrophotography, a developing roller of a contact type developing system, or a doctor roller of a developing apparatus.

Generally, when a cylindrical axially elongate rotary body is to be rotated in even contact with another rotary body which is rotatable in a fixed position and may also be cylindrical and axially elongate, it is undesirable to fix the axes of the two rotary bodies in position. This is because, should the axes be fixed, the outer peripheries of the two rotary bodies would fail to make contact with an even pressure distribution due to the scattering in the degree of circularity and that of linearity. Here, the words "circularity" and "linearity" of a rotary body should be understood to imply, respectively, the equality of radii as measured from the axis and the straightness of the outer periphery as measured in the lengthwise direction. It is, therefore, a common practice to urge the rotary body, which is to be rotated in contact with the other which is fixed in position, in a predetermined direction toward the latter by, for example, a spring, thereby forcing them into contact with each other. Such a scheme, however, gives no consideration to the magnitude, direction and others of a force which is applied from a driving section to the rotary body whose axis is movable. Specifically, assuming that the movable rotary body is driven in a rotary motion at only one of its opposite ends, the contact pressure differs from that driven end to the other end resulting that an even contact pressure distribution is unattainable in the lengthwise or axial direction of the rotary body. This is true with, for example, a register roller of a sheet feed mechanism, a doctor roller of a developing device, and others, not to speak of a photoconductive element and a developing roller.

SUMMARY OF THE INVENTION

It is, therefore, an object of the present invention to provide a device for driving a rotatable body which overcomes the drawback particular to the prior art arrangement as discussed above.

It is another object of the present invention to provide a device for driving a rotatable body which allows a cylindrical axially elongate rotary body to make even contact with another cylindrical rotary body in the axial direction.

It is another object of the present invention to provide a generally improved device for driving a cylindrical body.

A device for driving a rotary body of the present invention comprises a first rotary body fixed in place, a second rotary body supported to be movable in a predetermined direction into and out of contact with the first rotary body, a drive gear mounted on at least one end of a shaft portion of the second rotary body, and a drive gear meshing with the driven gear for driving the driven gear and, thereby, the second rotary body in a rotary motion. The drive gear is located at a position in which an angle $\theta$ between the direction of movement and a line extending through axes of the driven and drive gears is defined upstream of the direction of movement with respect to an intended direction of rotation of the second rotary body and substantially equal to a pressure angle $\alpha$ between the drive and driven gears.

The above and other objects, features and advantages of the present invention will become more apparent from the following detailed description taken with the accompanying drawings.

DESCRIPTION OF THE PREFERRED EMBODIMENTS

To better understand the present invention, a brief reference will be made to a prior art device for driving a rotary body.

Figure 1:
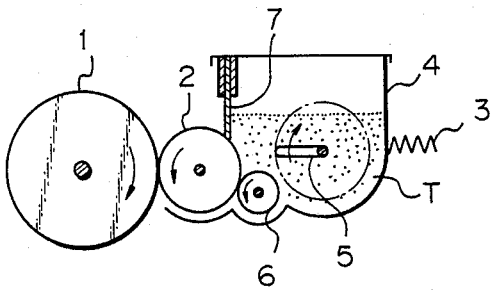
Fig. 1 PRIOR ART
FIG. 1 is a view showing a developing apparatus installed in an contact development type electrophotographic machine.
Figure 2:
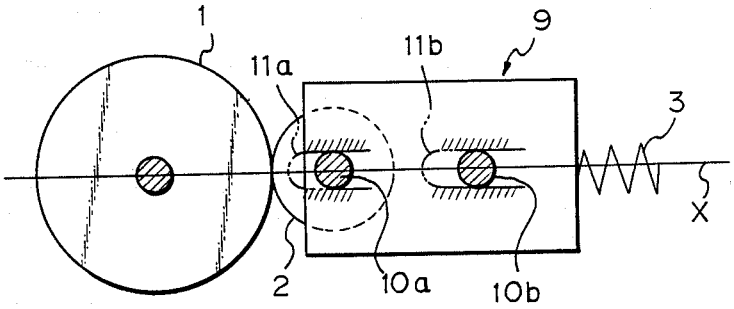
Fig. 2 PRIOR ART
FIG. 2 is a view showing a prior art driving device included in the developing apparatus of FIG. 1.

Referring to FIG. 1 of the drawings, a contact development type electrophotographic copier, for example, includes a photoconductive element 1 in the form of drum and a developing roller 2 each constituting a rotary body. A hopper 4 is biased by suitable pressing means such as a spring 3 so that the developing roller 2 is pressed against the drum 1. Disposed in the hopper 4 are an agitator 5 for agitating toner T, a toner supply roller 6 for supplying the toner T to the developing roller 2, and a doctor blade 7 for regulating the toner T on the roller 2 to form a thin toner layer. The drum 1 is rotatably supported by bearings, which are fixed in place, and driven in a direction indicated by an arrow in the figure (clockwise direction). The toner T agitated by the agitator 5 inside the hopper 4 is transported by the toner supply roller 6 to the developing roller 2 and, then, regulated by the doctor blade 7 to form a uniformly charged thin toner layer. As the developing roller 2 is rotated, the toner is brought to a predetermined developing station so that it is brought into contact with and transferred to the drum 1. By such a sequence of steps, an electrostatic latent image provided on the drum 1 is developed. In FIG. 2, the developing apparatus is generally designated by the reference numeral 9 and shown to be a single unit which includes the developing roller 2, toner supply roller 6, agitator 5, hopper 4 and doctor blade 7.

As shown in FIG. 2, the prior art developing unit 9 has two groups of pin-like rolls 10*a* and 10*b* which protrude from the side walls of the unit 9. The rolls 10*a* and 10*b* are located on a line X which extends through the axes of the drum 1 and developing roller 2. Slidably engaged with and guided by unmovable guides 11*a* and 11*b*, respectively, the rolls 10*a* and 10*b* are movable along the line X, i.e. in the X direction only. The spring 3 biases the developing roller 2 toward the drum 1 so that the two rotary bodies may stably contact each other with an even pressure distribution.

As previously discussed, a drawback with such a prior art developing unit 9 is that the contact pressure acting between the developing roller 2 and the drum 1 is not even in the lengthwise direction of the two rotary bodies because no consideration is given to the magnitude, direction and others of a force applied from a driving section, not shown, to the roller 2. This brings about various undesirable occurrences such as local omission of an image on a reproduction.

Figure 3:
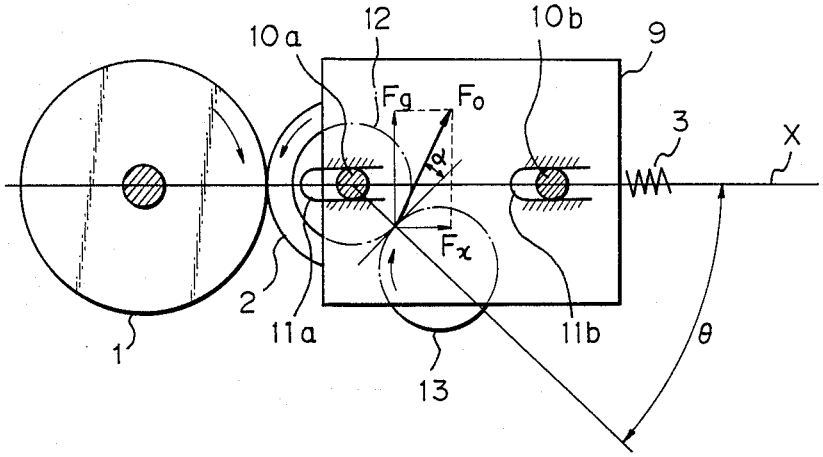
Fig. 3 PRIOR ART
FIGS. 3 and 4 are views useful for explaining a drawback particular to the prior art driving device.
Figure 4:
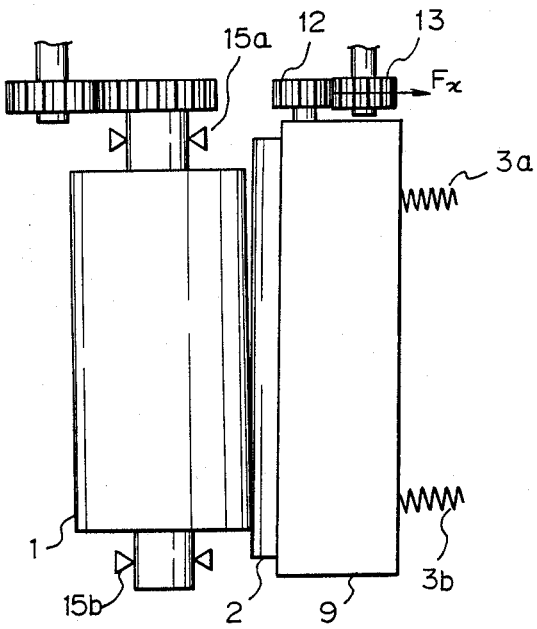
Fig. 4 PRIOR ART

Such a problematic situation will be described in more detail with reference to FIGS. 3 and 4. In the figures, the same structural elements as those shown in FIGS. 1 and 2 are designated by like reference numerals. As shown in FIG. 3, a force $F_0$ is imparted from a drive gear 13 to the developing roller 2 through a driven gear 12. The drive gear 13 is located upstream of the direction X by an angular distance of $\theta$ with respect to an intended direction of rotation (counterclockwise in FIG. 3) of the developing roller 2. Under this condition, since the magnitude and direction of the force $F_o$ acting on the developing roller 2 are not taken into account at all, the developing roller 2 is affected by a component $F_x$ *of the force* $F_o$ which tends to move the roller 2 away from the drum 1. Specifically, as shown in FIG. 4, that end of the developing roller 2 at which the driven gear 12 driven by the drive gear 13 is mounted is urged away from the drum 1. As a result, no toner or only a reduced amount of toner is transferred from a part of the surface of the developing roller 2 adjacent to that end to the drum 1, preventing a corresponding part of a latent image on the drum 1 from being developed. It is to be noted that when the position of the drive gear 13 relative to the driven gear 12 is different from that of FIG. 3, it may occur that the opposite end of the developing roller 2 to the end as discussed with reference to FIG. 4 is urge away from the drum 1. In FIG. 4, $\alpha$ is the pressure angle between the drive gear 13 and the driven gear 12, and the reference numerals 15*a* and 15*b* are representative of bearings which support the drum 1.

Figure 5:
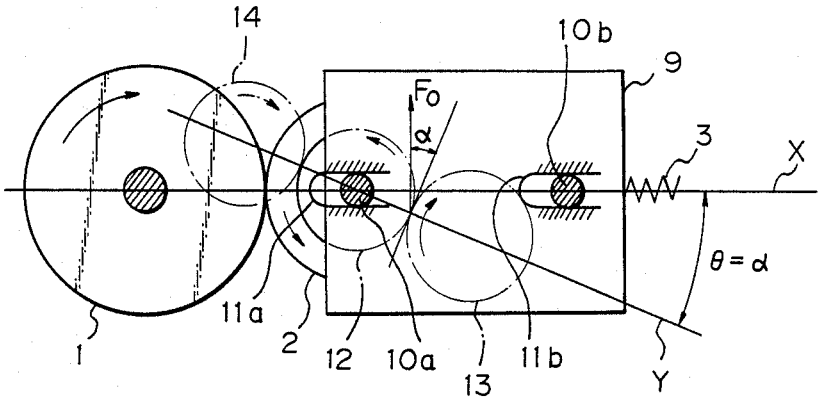
FIGS. 5 and 6 are views showing a driving device embodying the present invention.
Figure 6:
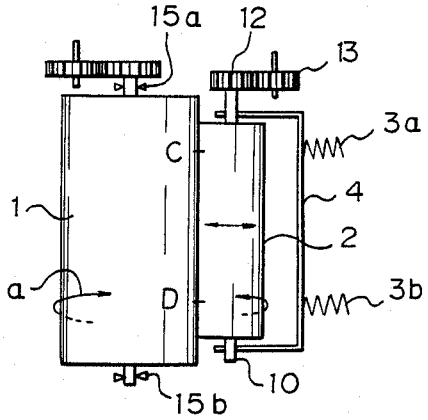

Referring to FIGS. 5 and 6, a device for driving a rotary body in accordance with the present invention is shown. This embodiment, too, is applied to a contact development type electrophotographic copier by way of example and, therefore, the same structural elements as those shown in FIGS. 1 to 4 are designated by like reference numerals.

As shown in the figures, the driven gear 12 is fixed to and substantially integrated with the end of a shaft of the developing roller 2 by a key or the like. The drive gear 13 is held in mesh with the driven gear 12. The drive gear 13 may alternatively be located at a position which is designated by the reference numeral 14. Assume that the pressure angle between the driven gear 12 and the drive gear 13 (or 14) is $\alpha$. The line X is representative of the direction of movement of the rolls 10*a* and 10*b* which is limited by the unmovable guide members 11*a* and 11*b*. In accordance with the present invention, the drive gear 13 is located in a particular position which is such that the angle $\theta$ between the direction X and the line extending through the axis of the driven gear 12 is substantially equal to the pressure angle $\alpha$ between the gears 12 and 13 and located upstream of the direction X with respect to the direction of rotation (counterclockwise in FIG. 5) of the developing roller 2.

As shown in FIG. 6, the drum 1 is fixed in position and supported by the bearings 15*a* and 15*b* to be rotatable as indicated by an arrow (clockwise). The developing roller 2 is supported in such a manner as to be movable relative to the drum 1 in the direction X which is defined by the interengaging rollers 10*a* and 10*b* and the guide members 11*a* and 11*b*. Assume that the angle between the direction X and a line Y, FIG. 5, extending through the axes of the drive and driven gears 12 and 13, respectively, is $\theta$, that the force exerted by the drive gear 13 is $F_o$, and that the pressure angle between the gears 12 and 13 is $\alpha$. Then, the force $F_x$ acting in the X direction is expressed as:

$$\begin{aligned} F_x &= F_o(\cos\theta - \tan(90^\circ + \alpha)\cdot\sin\theta) \\ &= F_o\cos(\theta + 90^\circ + \alpha)/\cos(90^\circ + \alpha) \end{aligned} \qquad \text{Eq. (1)}$$

As seen from the Eq. (1), under the conditions of $\theta = -\alpha$ or $\theta = (180^\circ - \alpha)$, $F_x$ becomes zero, i.e., the force $F_o$ for driving the developing roller 2 does not disturb the even contact pressure distribution between the drum 1 and the developing roller 2.

Figure 7:
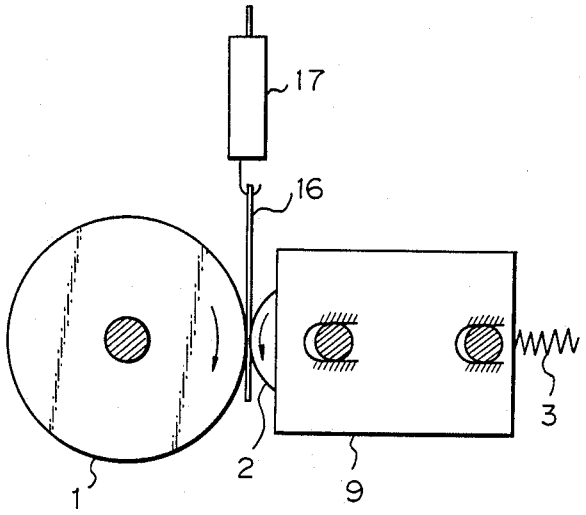
FIGS. 7 and 8 are views showing how to measure contact pressure between a photoconductive element and a developing roller.
Figure 8:
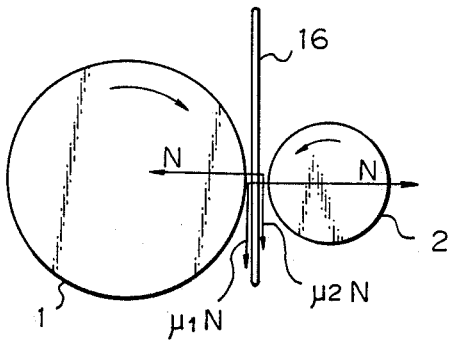

By using the device shown in FIG. 1 or 3 and changing the position of its drive gear 13, the contact pressure was actually measured at points C and D as shown in FIG. 6. For the measurement, the developing roller 2 was implemented with an NBR rubber having an outside diameter of 20 millimeters and a thickness of 6 millimeters and coated with urethan resin, the drum 1 was implemented with a metal tube having an outside diameter of 40 millimeters and applied with OPC, and the drive gear 13 and driven gear 12 were implemented with gears having a pressure angle of 20 degrees. Further, as shown in FIG. 7, a 10 millimeters wide and 40 microns thick polyester film 16 was inserted in between the drum 1 and the developing roller 2 so as to measure a pull P acting on the film 16 by means of a tension gauge 17, whereby a contact pressure N was determined. Assuming that the frictional force acting between the drum 1 and the polyester film 16 is $\mu_1$, and that the frictional force acting between the developing roller 2 and the film 16 is $\mu_2$, FIG. 8 shows the forces which are imparted to the film 16. Specifically, the following equation is derived from FIG. 8:

$$N = \frac{P}{\mu_1 + \mu_2} \qquad \text{Eq. (2)}$$

Figure 9:
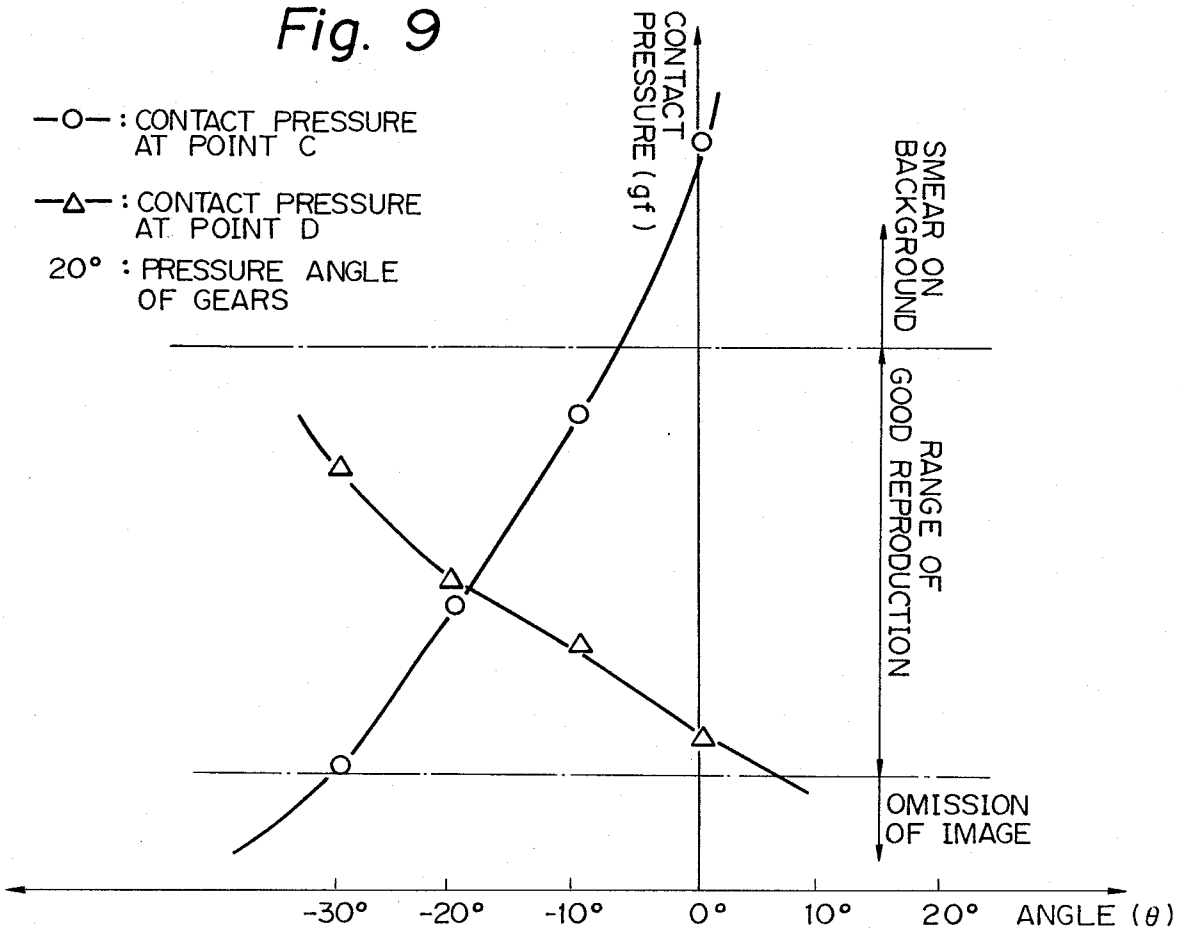
FIG. 9 is a chart showing a relationship between the position of a drive gear and the contact pressure.

As regards the relationship between the contact pressure N and the image, experiments showed that contact pressures N lower than 40 gf cause an image to be locally missed out while contact pressures N higher than 180 gf are apt to smear the background of an image. Such is shown in FIG. 9. Specifically, it will be seen from FIG. 9 that when $\theta$ is $-20$ degrees ($\theta = -\alpha$), the uneveness in the contact pressure acting between the drum 1 and the developing roller 2 is substantially reduced to zero and, therefore, an even contact pressure distribution is established throughout the length of the developing roller 2. It will also be understood that when the drive gear 13 is located in a position where $\theta$ is greater than $-20$ degrees, the driven gear 12 is pressed against the drum 1 to increase the pressure at the point C over the pressure at the point D while, when the drive gear 13 is located in a position where $\theta$ is smaller than $-20$ degrees, the drive gear 12 is urged away from the drum 1 to increase the pressure at the point D over the pressure at the point C. This is what the Eq. (1) implies. Further, it will be seen that when $\theta$ is smaller than $-35$ degrees, an image is apt to be missed out on that side of the drum 1 which corresponds to that side of the developing roller 2 where the roller 2 is driven by the gears 12 and 13 while, when $\theta$ is greater than $-5$ degrees, the background is apt to be smeared on the same side of the drum 1. Thus, it was revealed by the measurement that a quality image is attainable so long as the angle $\theta$ is equal to or greater than $-35$ degrees and equal to or smaller than $-5$ degrees.

Obviously, although the range in which the angle $\theta$ should be confined depends upon the conditions of particular equipment, e.g., the materials and outside diameters of two rotary bodies and the tolerable range of irregulrity in the contact pressure at the driving side or the driven side of the rotary bodies, the center value of $\theta$ is equal to $\alpha$.

Referring to FIGS. 10 to 18, there are shown other embodiments of the present invention.

Figure 10:
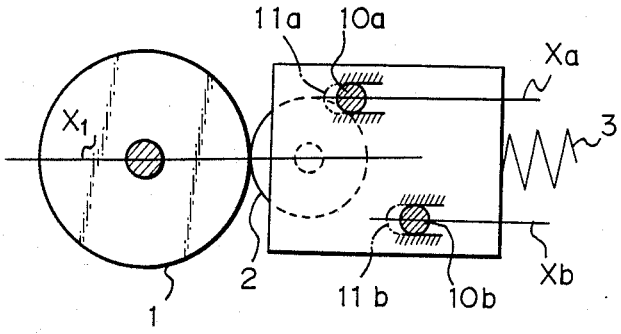
FIGS. 10, 11, 12, 13, 14, 15, 16, 17 and 18 are views each showing another embodiment of the present invention.

In the embodiment of FIG. 10, a line $X_1$ extending through the axes of the developing roller 2 and the drum 1 and directions $X_\alpha$ and $X_\beta$ of movement of the rollers 10*a* and 10*b*, respectively, which are defined by the guide members 11*a* and 11*b* are not aligned and, instead, extend parallel to each other. Nevertheless, since the direction of movement of the developing roller 2 toward and away from the drum 1 is $X_1$, all that is required is causing the gears to intermesh at a position which is deviated by the angle of $-\alpha$ from the direction $X_1$.

Figure 11:
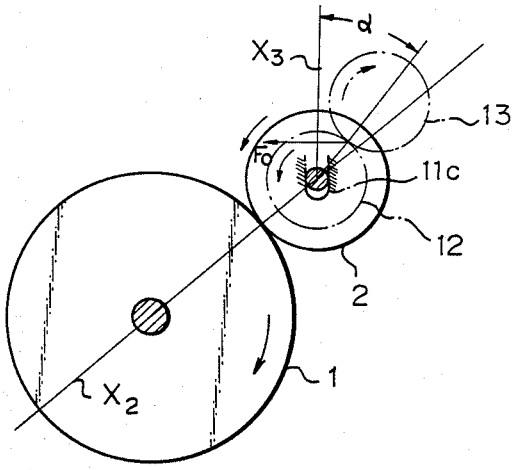

FIG. 11 shows a case wherein a line $X_2$ passing through the axes of the developing roller 2 and drum 1 is not parallel to a direction $X_3$ which is defined by a guide member 11*c*. In such a case, the position $(-\alpha)$ of the drive gear 13 relative to the driven gear 12 is determined by using the direction $X_3$ as a reference.

Figure 12:
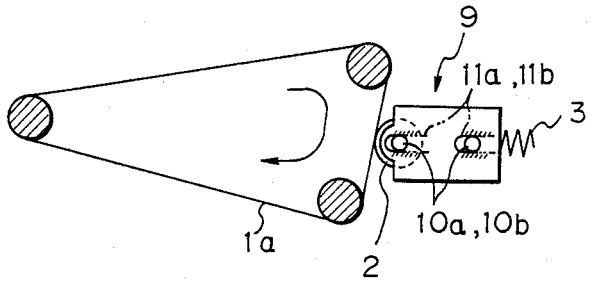

FIG. 12 shows an arrangement wherein the photoconductive element against which the developing roller 2 is to press itself is implemented with a belt 1*a*. In this condition, too, the relative position of the gears is determined by using the direction of movement of the developing roller 2 which is defined by the guide members 11*a* and 11*b* as a reference.

Figure 13:
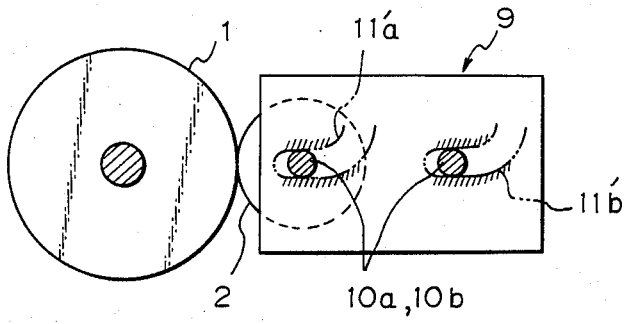

In FIG. 13, there is shown guide members 11'*a* and 11'*b* which are not linear in configuration. In this case, the relative position of the gears is determined based on a direction which is defined when the drum 1 and the developing roller 2 are brought into contact.

Figure 14:
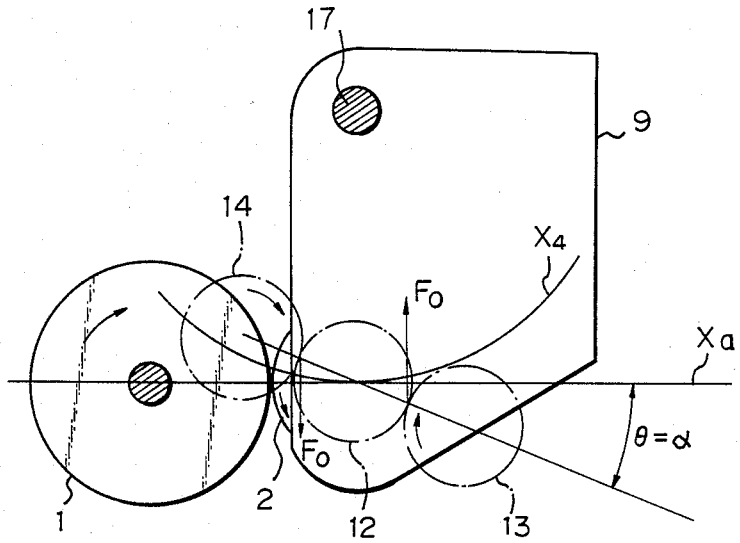
Figure 15:
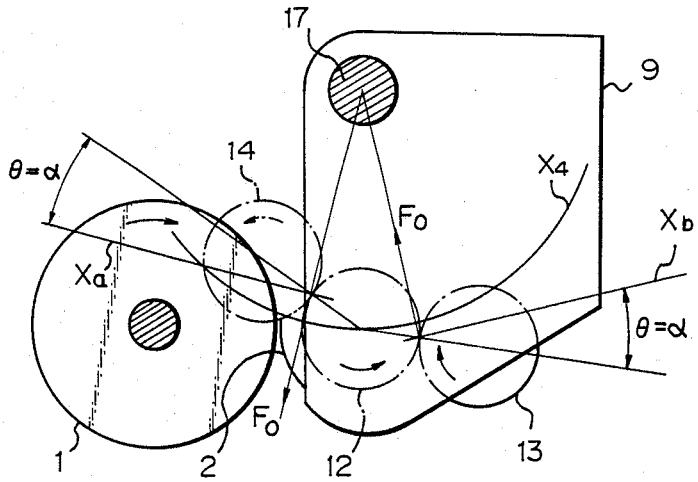

In the embodiment shown in FIG. 14, the developing unit 9 is rotatably supported by a pin 17. In this configuration, the developing unit 9 is movable along an arcuate path $X_4$ about the pin 17. Assuming that the direction which is tangential to the arc $X_4$ at the axis of the developing roller 2 when the roller 2 makes contact with the drum 1 is $X_\alpha$, the drive gear 13 is located at an angular distance of $\theta$ which is $-\alpha$ from the tangential direction $X_\alpha$. Alternatively, as shown in FIG. 15, the drive gear 13 (14) may be disposed at a position where the force $F_o$ exerted by the drive gear 13 (14) acts on a line which interconnects the center of rotation of the entire developing unit 9, i.e., pin 17 and the intermeshing point of the drive gear 13 (14) and driven gear 12. In any case, the drive force $F_o$ acts substantially perpendicular to the direction $X_4$ in which the developing unit 9 is movable, whereby the contact pressure is stabilized.

Figure 16:
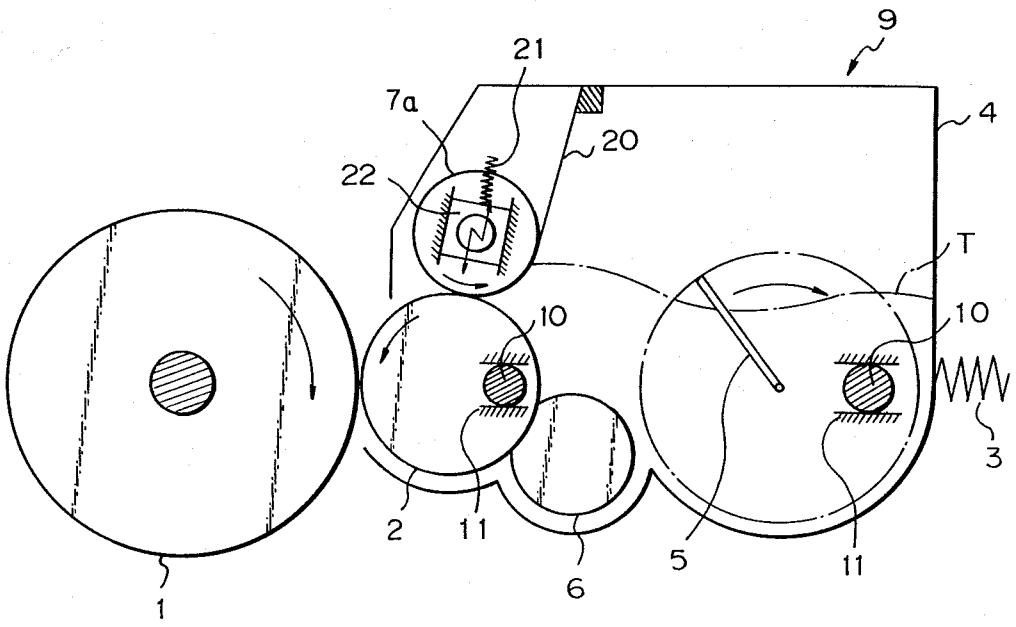

FIG. 16 shows an embodiment which is applied to a developing roller and a doctor roller. The developing unit 9 of FIG. 16, like those of the foregoing embodiments, includes the developing roller 2, toner supply roller 6, agitator 5, and hopper 4. In this particular embodiment, the developing unit 9 further includes a doctor roller 7*a*. The doctor roller 7*a* is supported by bearings 22 to be movable toward and away from the developing roller 2 so as to make even contact with the developing roller 2 despite any scattering in circularity and linearity. While the doctor roller 7*a* is shown as being pressed against the developing roller 2 by a spring 21, an arrangement may be made such that the roller 7*a* presses itself against the roller 2 by gravity.

Figure 17:
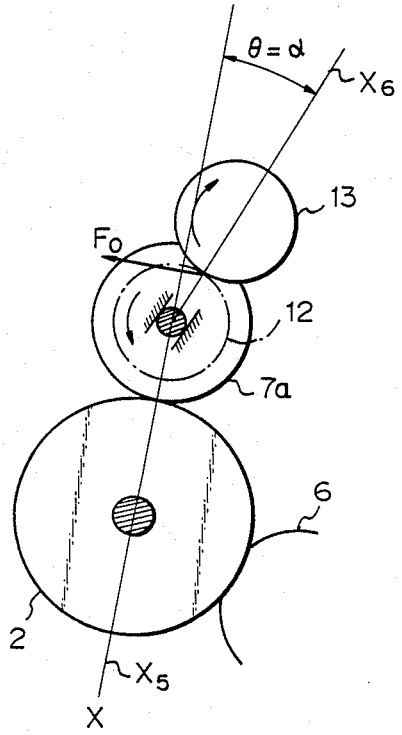

Although the developing unit 9 itself is movable relative to the drum 1, the developing roller 2 is fixed to the side walls of the unit 9 and the doctor roller 7*a* is movable relative to the roller 2. Hence, even in a case wherein the doctor roller 7*a* is driven, it is possible to stabilize the contact pressure between the developing roller 2 and the doctor roller 7*a* in the lengthwise direction by adopting the principle of the present invention. Specifically, as shown in FIG. 17, the direction of movement of the doctor roller 7*a* toward and away from the developing roller 2 is limited to a direction $X_5$, and the drive gear 13 is located at such a position that the angle $\theta$ between the direction $X_5$ and a line $X_6$ which interconnects the axes of the drive gear 13 and driven gear provided on the side walls of the developing unit 9 is substantially equal to the pressure angle $\alpha$ between the gears 12 and 13.

While in FIG. 16 the developing unit 9 is shown to bodily move toward the drum 1 to effect contact development, it may be fixed in place in the vicinity of the drum 1 with the doctor roller 7*a* moved toward and away from the developing roller 2. In such an alternative arrangement, the drive gear associated with the doctor roller 7*a* may be located outside of the side wall of the developing unit 9 (i. e. on the body side).

Figure 18:
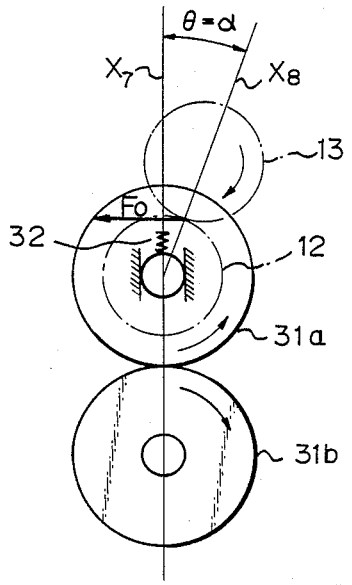

FIG. 18 shows an embodiment which is applied to a register roller which is installed in a sheet feed mechanism of a copier and others. As shown, a register roller 31*a* is movable toward and away from a register roller 31*b* which coacts with the register roller 31*a*, the register roller 31*a* being biased by a spring 32. Torque is transmitted to the register roller 31*a* from the drive gear 13 by way of the driven gear 12. To establish even contact of the register rollers 31*a* and 31*b*, the angle $\theta$ between a direction $X_7$ in which the register roller 31*a* is movable toward and away from the register roller 31*b* and a line $X_8$ extending through the axes of the drive gear 13 and driven gear 12 is defined upstream of the direction $X_7$ with respect to the direction of rotation (counterclockwise) of the register roller 31*a* and substantially equal to the pressure angle $\alpha$ of the gears.

In summary, it will be seen that the present invention provides a device which allows two rotary bodies to make contact with each other with an even pressure distribution in their lengthwise direction. This unprecedented advantages is derived from a unique arrangement wherein a drive gear, which meshes with a driven gear associated with a rotatry body which is movable toward and away from another rotary body which is fixed in place, is located such that the angle between a line interconnecting the axes of the drive and driven gears and a direction of movement of the movable rotary body is defined on the upstream side with respect to the direction of rotation of the movable rotary body and substantially equal to the pressure angle between the gears.

Various modifications will become possible for those skilled in the art after receiving the teachings of the present disclosure without departing from the scope thereof.

What is claimed is:

1. A device for driving a rotary body, comprising a first rotary body fixed in place;

a second rotary body supported to be movable in a predetermined direction into and out of contact with said first rotary body;

a driven gear mounted on at least one end of a shaft portion of said second rotary body; and a drive gear meshing with said driven gear for driving said driven gear and, thereby, said second rotary bodyin a rotary motion;

said drive gear being located at a position in which an angle $\theta$ between said direction of movement and a line extending through axes of said driven and drive gears is defined upstream of said direction of movement with respect to an intended direction of rotation of said second rotary body and substantially equal to a pressure angle $\alpha$ between said drive and driven gears.

2. A device as claimed in claim 1, wherein a force imparted from said drive gear to said driven gear acts in a direction substantially perpendicular to said direction of movement.

3. A device as claimed in claim 1, wherein said angle $\theta$ is equal to or larger than $-35$ degrees and equal to or smaller than $-5$ degrees.

4. A device as claimed in claim 1, wherein said first rotary body comprises a photoconductive element, and said second rotary body comprises a developing roller.

5. A device as claimed in claim 1, wherein said first rotary body comprises a developing roller, and said second rotary body comprises a doctor roller.

6. A device as claimed in claim 1, wherein said first and second rotary bodies individually comprise register rollers which are provided in a pair for feeding a paper sheet.

* * * * *